United States Patent [19]

Yagi et al.

[11] Patent Number: 5,004,680

[45] Date of Patent: Apr. 2, 1991

[54] HIGH-SPEED AND WELL-PRESERVABLE SILVER HALIDE PHOTOGRAPHIC LIGHT-SENSITIVE MATERIAL

[75] Inventors: Toshihiko Yagi, Shiroyama; Kenji Kumashiro, Hachioji; Hideki Takiguchi, Sagamihara, all of Japan

[73] Assignee: Konica Corporation, Tokyo, Japan

[21] Appl. No.: 359,615

[22] Filed: Jun. 1, 1989

[30] Foreign Application Priority Data

Jun. 28, 1988 [JP] Japan ..... 63-161174

[51] Int. Cl.[5] ..... G03C 1/08; G03C 1/34

[52] U.S. Cl. ..... 430/603; 430/567; 430/607; 430/608

[58] Field of Search ..... 430/264, 567, 569, 603, 430/607, 608

[56] References Cited

U.S. PATENT DOCUMENTS

| | | | |
|---|---|---|---|
| 1,898,512 | 2/1933 | Wendt | 530/354 |
| 4,668,614 | 5/1987 | Takada | 430/567 |
| 4,728,602 | 3/1988 | Shibahara et al. | 430/567 |
| 4,762,778 | 8/1988 | Yamazaki et al. | 430/567 |
| 4,835,095 | 5/1989 | Ohashi et al. | 430/569 |
| 4,863,846 | 9/1989 | Tanaka et al. | 430/603 |

FOREIGN PATENT DOCUMENTS

| | | |
|---|---|---|
| 0147854 | 7/1985 | European Pat. Off. . |
| 467179 | 10/1928 | Fed. Rep. of Germany . |
| 3310609 | 10/1983 | Fed. Rep. of Germany . |
| 1161413 | 8/1969 | United Kingdom . |

*Primary Examiner*—Hoa Van Le

*Attorney, Agent, or Firm*—Finnegan, Henderson, Farabow, Garrett and Dunner

[57] ABSTRACT

A silver halide photographic light-sensitive material is disclosed which has a high speed with a low fog and is improved on the long-term preservability. The light-sensitive material comprises a support having thereon a photographic component layer including at least one silver halide emulsion layer, in which the silver halide emulsion layer comprises silver halide grains, each of which are comprised of two or more phases different in the silver iodide content, wherein the average silver iodide content of the grain is higher than the silver iodide content of the external phase of the grain, and to at least one layer included the photographic component layer is added elementary sulfur in a step of manufacturing process of the silver halide photographic light-sensitive material.

17 Claims, No Drawings

HIGH-SPEED AND WELL-PRESERVABLE SILVER HALIDE PHOTOGRAPHIC LIGHT-SENSITIVE MATERIAL

FIELD OF THE INVENTION

The present invention relates to a silver halide color photographic light-sensitive material and a method for the manufacture thereof, and more particularly to a high-speed silver halide color photographic material excellent in the long-term preservability.

BACKGROUND OF THE INVENTION

There are many conventionally known methods for sensitizing silver halide photographic light-sensitive materials, which include the spectral sensitization by use of sensitizing dyes; the noble metal sensitization by use of salts of noble metals such as gold, platinum, iridium, etc.; the sulfur sensitization by use of active gelatin, sodium thiosulfate, thioacetamide, allyl-isothiourea, etc.; the selenium sensitization by use of colloidal selenium, selenourea, etc.; the reduction sensitization by use of a stannous salt, polyamine, hydrazine derivative, etc.: the development acceleration by use of a salt of nitrogen-, phosphorus- or sulfur-polyonium, or of a polyalkylene glycol; or the like. In the actual photographic industry, such sensitizing techniques are used in arbitrary combination according to purposes to manufacture an objective silver halide photographic material, but any techniques capable of adequately meeting the demand for the long-term preservability have not yet been established. So, attempts have now been exerted to make the light-sensitive material still further highly sensitive by additionally applying a novel sensitizing technique to the silver halide photographic material that has been sensitized by combining some of these well-known sensitizing techniques or by employing such the novel sensitizing technique alone. However, the improvement is still not sufficient.

On the other hand, regarding the technique on silver halide grains for raising the photographic speed of a silver halide emulsion, there are those monodisperse-type and tabular-type core/shell emulsions as disclosed in Japanese Patent Publication Open to Public Inspection (hereinafter referred to as Japanese Patent O.P.I. Publication) Nos. 138538/1985, 143331/1985, U.S. Pat. No. 4,444,877, Japanese Patent O.P.I. Publication Nos. 99433/1984 and 35726/1985. The technique for these emulsions is a device made in the latent image forming process so that the light that has been absorbed into the inside of a silver halide grain is efficiently transformed into a development speck. The technique, however, has been demanded yet to be improved on the emulsion's long-term preservability.

SUMMARY OF THE INVENTION

It is an object of the present invention to provide a silver halide photographic light-sensitive material which, in view of the above-mentioned problems, has a high photographic speed with a low fog and is improved on the long-term preservability.

The above object of this invention is accomplished by a silver halide photographic light-sensitive material comprising a support having thereon a photographic component layer including at least one silver halide emulsion layer, in which the silver halide emulsion layer comprises silver halide grains, each of which is comprised of two or more phases different in the silver iodide content, wherein the average silver iodide content of the grain is higher than the silver iodide content of the external phase of the grain, and to at least one layer included in said photographic component layer is added elementary sulfur in a step of the manufacturing process of the silver halide photographic light-sensitive material.

DETAILED DESCRIPTION OF THE INVENTION

The present invention will be illustrated further in detail.

In the silver halide grain of this invention, the average silver iodide content of the grain being higher than the silver iodide content of the external phase of the grain can be measured and determined by the following method:

If the silver halide emulsion of this invention is an emulsion containing silver halide grains wherein the average of the grain diameters/grain thicknesses ratio is less than 5, the emulsion, when comparing the average silver iodide content ($J_1$) found by the fluorescence X-ray analysis and the silver iodide content of the grain surface ($J_2$) found by the X-ray photoelectron spectrometry, satisfies the relation of $J_1 > J_2$.

The term 'grain diameter' used herein means the diameter of a circumcircle surrounding the projection image of a grain when its projected image area becomes the maximum.

The X-ray photoelectron spectrometry will be explained.

Prior to the measurement by the X-ray photoelectron spectrometry, an emulsion is subjected to the following pretreatment: Firstly, a pronase solution is added to the emulsion, and the mixture is stirred for an hour at 40° C. for gelatin decomposition. And the liquid is then subjected to centrifugal separation to have its emulsion grains precipitated. After removing the supernatant liquid in decanting manner, to the product is added a pronase solution to perform again gelatin decomposition under the same condition as the above. This sample is again subjected to centrifugal separation and decantation in like manner, and distilled water is added to it to redisperse the emulsion grains into the distilled water. The dispersed liquid is subjected to centrifugal separation and then decanted. After repeating this washing manner three times, the emulsion grains are then redispersed into ethanol. This is then thinly coated on a mirror-ground silicon wafer to thereby prepare a sample for measurement.

A measuring instrument for use in the measurement according to the X-ray photoelectron spectrometry may be, e.g., ESCA/SAM 560 manufactured by PHI Co.. which uses Mg-Kα ray as its excitation X-ray and operates under the conditions of an X-ray supply voltage of 15 KV, an X-ray supply potential of 40 mA and a path energy of 50 eV.

In order to find the surface halide composition, Ag 3d, Br 3d and I 3d 3/2 electrons are to be detected. Calculation of the composition ratio is carried out according to the relative sensitivity coefficient method by using the integral strength of each peak. By using 5.10, 0.81 and 4.592 as the Ag 3d, Br 3d and I 3d 3/2 relative sensitivity coeffients, respectively, the composition ratio is given in atom percentages.

The silver halide emulsion of this invention, when containing silver halide grains in which the average of the grain diameters/grain thicknesses ratio is less than 5, is desirable to be monodisperse in the grain size distribution. The monodisperse silver halide emulsion herein means one in which the weight of the silver halide included within the grain size range of the average grain diameter d±20% accounts for more than 60%, preferably more than 70%, and more preferably more than 80% of the weight of the whole silver halide grains.

The average grain diameter d herein is defined as the grain diameter di when the product of the frequency ni of grain diameter di and $di^3$ becomes the maximum (significant three figures: rounded to three decimal places).

The grain diameter herein, in the case of a spherical silver halide grain, is its diameter, while in the case of a nonspherical silver halide grain, is the diameter of a circular image corresponding in the area to its projection image.

The grain diameter can be obtained by experimental measurement of the grain diameter of each grain photographic image or of the area of each grain projection image magnified 10,000 to 50,000 times by an electron microscope (the number of grains to be measured should be not less than 1000 at random).

The most preferred highly monodisperse emulsion of this invention is one whose grain diameter distribution width, when defined as $$\frac{\text{standard deviation of grain diameter distribution}}{\text{average grain diameter}} \times 100 = \text{distribution width (\%)},$$

is less than 20%, and more preferably less than 15%.

Herein, the average grain diameter and the standard deviation of the grain diameter distribution should be found from the di as defined previously.

In the silver halide grains of this invention, when the average of their grain diameters/grain thicknesses ratio is less than 5, the average grain diameter is preferably from 0.2 to 5 μm, more preferably from 0.5 to 3 μm, and most preferably from 0.6 to 1.5 μm.

The silver halide emulsion of this invention, if it is a tabular silver halide emulsion in which the average of its grain diameters/grain thicknesses ratio is not less than 5, when comparing the average silver iodide content ($J_1$) found in accordance with the foregoing fluorescent X-ray analysis method and the average silver iodide content ($J_3$) obtained by being measured by using the X-ray microanalysis method on the silver halide crystal at a point more than 80% away in the diameter direction from its center, satisfy the relation of $J_1 > J_3$.

In the present invention, in the case of the tabular silver halide emulsion in which the average of its grain diameters/grain thicknesses ratio is not less than 5, its grain diameter is defined as the diameter of a circumcircle surrounding its projection image when its projected image area becomes the maxium. Also, the center of the grain is defined as the center of the circumcircle.

The X-ray microanalysis method will now be explained.

Silver halide grains are dispersed into an electron microscope observation grid composed of an electron microscope equipped with an energy dispersion-type X-ray analyzer, and the magnification is adjusted under the liquid nitrogen cooling condition so that one single grain alone comes in the CRT display field, and the strengths of AgLα and ILα rays are integrated for a given period of time. By using a calibration curve with the ILα/AgLα strength ratio prepared in advance the silver iodide content can be calculated.

In the tabular silver halide emulsion in which the average of its grain diameters/grain thicknesses ratio is not less than 5, the average of its grain diameters/grain thicknesses ratio is preferably from 6 to 100, and more preferably from 7 to 50.

The average silver iodide content of the silver halide grain of this invention is preferably from 2 to 20 mole %, more preferably from 5 to 15 mole %, and most preferably from 6 to 12 mole %.

The silver iodide content of the grain surface ($J_2$) according to the X-ray photoelectron spectrometry in the silver halide emulsion of this invention in which the average of its grain diameters/grain thicknesses is less than 5 is preferably from 6 mole % to zero, more preferable from 5 mole % to zero, and most preferably from 4 mole % to 0.01 mole %.

In the tabular silver halide emulsion of this invention in which the average of its grain diameters/grain thicknesses ratio is not less than 5, the average of the silver iodide content values ($J_3$) measured in accordance with the X-ray microanalysis method on the silver halide crystal at a point more than 80% away in the diameter direction from its center is preferably from 6 mole % to zero, more preferably from 5 mole % to zero, and most preferably from 4 mole % to 0.01 mole %. The average thickness of the tabular silver halide grains is preferably from 0.3 to 0.05 μm, and more preferably from 0.3 to 0.05 μm. The average grain diameter of the silver halide grains contained in the tabular silver halide emulsion is preferably from 0.5 to 30 μm, and more preferably from 1.0 to 20 μm.

The foregoing tabular silver halide emulsion in which the average of its grain diameters/grain thicknesses ratio is not less than 5, which is suitably usable in this invention, is desirable to be one in which silver iodide is present locally in the center of its each grain.

The core/shell-type silver halide emulsion in which the average of its grain diameters/grain thicknesses ratio is less than 5 is of the grain structure comprised of two or more phases different in the silver iodide content and comprises silver halide grains of which the phase having the highest silver iodide content (referred to as core) is other than the outmost surface phase (referred to as shell).

The silver iodide content of the internal phase (core) having the highest silver iodide content is preferably from 6 to 40 mole %, more preferably from 8 to 30 mole %, and most preferably from 10 to 20 mole %.

The shell portion's share of the core/shell-type silver halide grain is preferably from 10 to 80% by volume, more preferably from 15 to 70% by volume, and most preferably from 20 to 60% by volume.

The core portion's share of the whole grain is preferably from 10 to 80% by volume, and more preferably from 20 to 50% by volume.

In the present invention, the differential change in the silver iodide content of the silver halide grain between the higher silver iodide-content core portion and the lower silver iodide-content shell portion may be of either sharp boundary or continuous change with no clear boundary. Also, the silver halide grain having a medium silver iodide-content intermediate phase between the core portion and the shell portion may be suitably used.

Regarding the above-mentioned intermediate phase-having core/shell-type silver halide, the volume of its intermediate phase should account for 5 to 60%, and preferably 20 to 55% of the whole grain. Difference in the silver iodide content between the shell and the intermediate phase and that between the intermediate phase and the core are each preferably 3 mole % or more, and difference in the silver iodide content between the shell and the core is preferably 6 mole % or more.

The core/shell-type silver halide emulsion is desirable to be a silver iodobromide emulsion, and its average silver iodide content is preferably from 4 to 20 mole %, and more preferably from 5 to 15 mole %. The emulsion may also contain silver chloride within limits not impairing the effect of this invention.

The core/shell-type silver halide emulsion can be prepared in accordance with any of those known methods as disclosed in Japanese Patent O.P.I. Publication Nos. 177535/1984, 138538/1985, 52238/1984, 143331/1985, 35726/1985 and 258536/1985.

In the case where the core/shell-type silver halide emulsion is prepared by growing its grains starting from seed grains in accordance with such a method as described in the example of Japanese Patent O.P.I. Publication No. 138538/1985, the grain can have in its center a silver halide composition region that is different from the core.

In this instance, the halide composition of the seed grain may be any arbitrary one such as silver bromide, silver iodobromide, silver chloroiodobromide, silver chlorobromide, silver chloride or the like, but silver iodobromide whose silver iodide content is not more than 10 mole % or silver bromide is preferred.

The seed grain's share of the whole silver halide is preferably not more than 50% by volume, and particularly preferably not more than 10% by volume.

The silver iodide distribution condition in the above core/shell-type silver halide grain can be detected in accordance with various physical measurement methods: for example, examined by the method of measuring luminescence at a low temperature or the X-ray diffraction method as described in the collection of summaries of the lectures delivered to the '81 Annual General Meeting of the Society of Photographic Science and Technology of Japan.

The core/shell-type silver halide grain may be in the form of a regular crystal such as a cubic, tetradecahedral or octahedral crystal, of a twin crystal or of a mixture of these crystals, but is preferably in the regular crystal form.

The composition of the tabular silver halide grain applicable to this invention wherein the average of its grain diameters/grain thicknesses ratio is not less than 5 and whose silver iodide is present locally in its center is desired to be silver iodobromide, but may also be silver chloroiodobromide containing not more than 5 mole % silver chloride. The high iodide-content phase in the center of such the silver halide grain should account for preferably not more than 80% of the whole volume of the grain, and particularly preferably from 60 to 10% of the whole grain. The silver iodide content of the central portion of the grain is preferably from 5 to 40 mole %, and particularly preferably from 10 to 30 mole %. The low silver iodide-content phase (peripheral portion) surrounding the high iodide-content phase in the central portion is desirable to be composed of silver iodobromide whose silver iodide content is from zero to 10 mole %, and more preferably from 0.1 to 6.0 mole %.

The tabular silver halide emulsion with silver iodide being present locally in the central portion of the grain thereof can be obtained in accordance with those known methods as disclosed in Japanese Patent O.P.I. Publication No. 99433/1984 and the like.

The term 'elementary sulfur' used in this invention means simple-substance sulfur, not in the form of a compound of it combined with other elements. Therefore, those sulfur-containing compounds known as photographic additives to those skilled in the art, such as, e.g., sulfides, sulfuric acid or its salts, sulfurous acid or its salts, thiosulfuric acid or its salts, sulfonic acid or its salts, thioether compounds, thiourea compounds, mercapto compounds, sulfur-containing heterocyclic compounds and the like, are not included in the 'elementary sulfur' of this invention.

The simple-substance sulfur to be used as the elementary sulfur in this invention is known to have some allotropes. Any of these allotropes may be used. Of these allotropes one that is stable at room temperature is $\alpha$-sulfur belonging to the rhombic system. In this invention, this $\alpha$-sulfur is desirable to be used.

When adding the elementary sulfur of this invention, it may be added in the solid form, but is preferable to be added in the form of a solution. The elementary sulfur is known to be insoluble in water but soluble in carbon disulfide, sulfur chloride, benzene, diethyl ether, ethanol, and the like, so that the elementary sulfur is desirable to be dissolved into any of these solvents to be added. Of these solvents for the elementary sulfur, ethanol is particularly suitably used from the handling and photographically harmless points of view.

The proper adding amount of the elementary sulfur depends on the degree of the expected effect as well as on the type of the silver halide emulsion to which it is to be added, but is normally from $10^{-5}$ mg to 10 mg per mole of silver halide. The whole amount of the elementary sulfur may be added either at a time or in several installments.

The photographic layer to which the elementary sulfur of this invention is to be added is allowed to be any one of light-sensitive silver halide emulsion layers and non-light-sensitive hydrophilic colloid layers, but the elementary sulfur is preferably added to a light-sensitive silver halide emulsion layer. When the elementary sulfur is added to the non-light-sensitive hydrophilic colloid layer, the elementary sulfur is supplied to the emulsion layer from the colloid layer after these layers are coated.

Regarding the point of time when the elementary sulfur is to be added to the silver halide emulsion layer, it may be added in the course of an arbitrary process up to the formation of a silver halide emulsion layer; i.e., at an arbitrary point of time before or during the formation of silver halide grains, from upon completion of the formation of silver halide grains up to the start of chemical sensitization, at the beginning of or during the period of the chemical sensitization, at the time of completion of the chemical sensitization, or during the period from upon completion of the chemical sensitization up to the time of coating. Preferably it is added at the beginning of, during the period of or up to the completion of the chemical sensitization.

The chemical sensitization beginning process is a process of adding a chemical sensitizer to the silver halide emulsion, and in this process, when a chemical sensitizer has been added is the time of beginning the chemical sensitization.

The above chemical sensitization can be stopped by any of those methods known to those skilled in the art, including a method of lowering temperature, a method of lowering pH, a method which uses a chemical sensitization stopping agent, and the like. In consideration of the stability of an emulsion, the method which uses a chemical sensitization stopping agent is preferred. Those compounds known as the chemical sensization stopping agent include halides such as potassium bromide, sodium chloride, etc., and organic compounds known as antifoggants or stabilizing agents such as 7-hydroxy-5-methyl-1,3,4,7a-tetrazaindene, etc. These compounds may be used alone or in combination.

The elementary sulfur according to this invention may be added in the chemical sensitization stopping process, wherein the chemical sensitization stopping process is a process in which the above-mentioned chemical sensitization stopping agent is added to the emulsion. In this instance, the addition of the elementary sulfur need only be made substantially in the course of the chemical sensitization stopping process; to be more concrete, simultaneously with or within 10 minutes before or after the addition of the chemical sensitization stopping agent, and preferably simultaneously with or within 5 minutes before or after the addition of the chemical sensitization stopping agent.

The silver halide emulsion to be used in the light-sensitive material of this invention may be chemically sensitized in usual manner, and may also be optically sensitized to desired wavelength regions by using sensitizing dyes.

To the silver halide emulsion may be added an antifoggant, a stabilizer, and the like. As the binder for this emulsion gelatin may be advantageously used.

The emulsion layers and other hydrophilic colloid layers of the light-sensitive material of this invention may be hardened, and also may contain a plasticizer and water-insoluble or less-insoluble synthetic polymer-dispersed products (latex).

In the emulsion layers of a color photographic light-sensitive material to which this invention is applied, couplers are used.

Further, compensation effect-having colored couplers, competing couplers, and compounds which, as a result of their coupling with the oxidation product of a developing agent, are capable of releasing photographically useful fragments such as development accelerator, bleaching accelerator, developing agent, silver halide solvent, toning agent, hardener, fogging agent, antifoggant, chemical sensitizer, spectral sensitizer, desensitizer, and the like, may be used. The light-sensitive material may have auxiliary layers such as filter layer, antihalation layer, antiirradiation layer, and the like. These layers and/or emulsion layers may contain dyes which are to be dissolved out of the light-sensitive material or to be bleached while being developed.

To the light-sensitive material may be added formalin scavenger, brightening agent, matting agent, lubricant, image stabilizer, surfactant, anti-color-fogging agent, development accelerator, development retarder, bleaching accelerator, and the like.

As the support, polyethylene-laminated paper, polyethylene terephthalate film, baryta paper, cellulose triacetate film and the like may be used.

In order to obtain a dye image by using the light-sensitive material of this invention, the light-sensitive material, after being imagewise exposed, may be subjected to a well-known color photographic processing.

EXAMPLE

The following is an example of the present invention, but the embodiment of this invention is not limited to and by the example.

In all the following example, the adding amounts to the silver halide photographic light-sensitive material are in grams per square meter unless otherwise stated. Also, the amounts of silver halide and colloidal silver are silver equivalents.

On a triacetyl cellulose film support were coated the following compositions-having layers in order from the support side, whereby a multicolor photographic element Sample 1 was prepared.

Sample 1 (Comparative)

| | |
|---|---|
| Layer 1: Antihalation layer (HC-1) | |
| Black colloidal silver | 0.20 |
| UV absorbing agent (UV-1) | 0.20 |
| Colored coupler (CC-1) | 0.05 |
| Colored coupler (CM-1) | 0.05 |
| High-boiling solvent (Oil-1) | 0.20 |
| Gelatin | 1.5 |
| Layer 2: Intermediate layer (IL-1) | |
| UV absorbing agent (UV-1) | 0.01 |
| High-boiling solvent (Oil-1) | 0.01 |
| Gelatin | 1.5 |
| Layer 3: Low-speed red-sensitive emulsion layer (RL) | |
| Silver iodobromide emulsion (Em-1) | 0.8 |
| Silver iodobromide emulsion (Em-2) | 0.8 |
| Sensitizing dye (SD-1) | $2.5 \times 10^{-4}$ mol per mol of silver |
| Sensitizing dye (SD-2) | $2.5 \times 10^{-4}$ mol per mol of silver |
| Sensitizing dye (SD-3) | $0.5 \times 10^{-4}$ mol per mol of silver |
| Cyan coupler (C-1) | 1.0 |
| Cyan coupler (C-2) | 0.05 |
| Colored cyan coupler (CC-1) | 0.05 |
| DIR compound (D-1) | 0.002 |
| High-boiling solvent (Oil-1) | 0.5 |
| Gelatin | 1.5 |
| Layer 4: High-speed red-sensitive emulsion layer (RH) | |
| Silver iodobromide emulsion (Em-3) | 2.0 |
| Sensitizing dye (SD-1) | $2.0 \times 10^{-4}$ mol per mol of silver |
| Sensitizing dye (SD-2) | $2.0 \times 10^{-4}$ mol per mol of silver |
| Cyan coupler (C-1) | 0.25 |
| Cyan coupler (C-2) | 0.015 |
| Colored cyan coupler (CC-1) | 0.05 |
| DIR compound (D-1) | 0.05 |
| High-boiling solvent (Oil-1) | 0.05 |
| Gelatin | 1.5 |
| Layer 5: Intermediate layer (IL-2) | |
| Gelatin | 0.5 |
| Layer 6: Low-speed green-sensitive emulsion layer (GL) | |
| Silver iodobromide emulsion (Em-1) | 1.0 |
| Sensitizing dye (SD-4) | $5 \times 10^{-4}$ mol per mol of silver |
| Sensitizing dye (SD-5) | $1 \times 10^{-4}$ mol per mol of silver |
| Magenta coupler (M-1) | 0.5 |
| Colored magenta coupler (CM-1) | 0.01 |
| DIR compound (D-3) | 0.02 |
| DIR compound (D-4) | 0.020 |
| High boiling solvent (Oil-2) | 0.3 |
| Gelatin | 1.0 |
| Layer 7: Intermediate layer (IL-3) | |
| Gelatin | 0.8 |
| Layer 8: High-speed green-sensitive emulsion layer (GH) | |
| Silver iodobromide emulsion (Em-3) | 1.3 |
| Sensitizing dye (SD-6) | $1.5 \times 10^{-4}$ mol per mol of silver |
| Sensitizing dye (SD-7) | $2.5 \times 10^{-4}$ mol per mol of silver |
| Sensitizing dye (SD-8) | $0.5 \times 10^{-4}$ mol per mol of silver |
| Magenta coupler (M-2) | 0.05 |
| Magenta coupler (M-3) | 0.15 |
| Colored magenta coupler | 0.05 |

-continued

| | |
|---|---|
| (CM-3) | |
| DIR compound (D-3) | 0.01 |
| High-boiling solvent (Oil-3) | 0.5 |
| Gelatin | 1.0 |
| Layer 9: Yellow filter layer (YC) | |
| Yellow colloidal silver | 0.1 |
| Anti-color-stain agent (SC-1) | 0.1 |
| High-boiling solvent (Oil-3) | 0.1 |
| Gelatin | 0.8 |
| Layer 10: Low-speed blue-sensitive emulsion layer (BL) | |
| Silver iodobromide emulsion (Em-1) | 0.25 |
| Silver iodobromide emulsion (Em-2) | 0.25 |
| Sensitizing dye (SD-10) | $7 \times 10^{-4}$ mol per mol of silver |
| Yellow coupler (Y-1) | 0.5 |
| Yellow coupler (Y-2) | 0.1 |
| DIR compound (D-2) | 0.01 |
| High-boiling solvent (Oil-3) | 0.3 |
| Gelatin | 1.0 |
| Layer 11: High-speed blue-sensitive emulsion layer (BH) | |
| Silver iodobromide emulsion (Em-4) | 0.8 |
| Sensitizing dye (SD-9) | $1 \times 10^{-4}$ mol per mol of silver |
| Sensitizing dye (SD-10) | $3 \times 10^{-4}$ mol per mol of silver |
| Yellow coupler (Y-1) | 0.30 |
| Yellow coupler (Y-2) | 0.05 |
| High-boiling solvent (Oil-3) | 0.15 |
| Gelatin | 1.1 |

-continued

| | |
|---|---|
| Layer 12: First protective layer (PRO-1) | |
| UV absorbing agent (UV-1) | 0.10 |
| UV absorbing agent (UV-2) | 0.05 |
| High-boiling solvent (Oil-1) | 0.1 |
| High-boiling solvent (Oil-4) | 0.1 |
| Formalin scavenger (HS-1) | 0.5 |
| Formalin scavenger (HS-2) | 0.2 |
| Gelatin | 1.0 |
| Layer 13: Second protective layer (PRO-2) | |
| Surface active agent (SU-1) | 0.005 |
| Alkali-soluble matting agent (average particle diameter 2 μm) | 0.05 |
| Polymethyl methacrylate (average particle diameter 3 μm) | 0.05 |
| Sliding agent (WAX-1) | 0.04 |
| Gelatin | 0.6 |

Also, in addition to the above component compounds, coating aid Su-2, dispersing assistant Su-3, hardening agents H-1 and H-2, stabilizer ST-1, and antifoggants AF-1 and AF-2 were added to each of the above layers.

Emulsions Em-1 through Em-4 were subjected to optimum ripening with use of sodium thiosulfate, chloroauric acid and ammonium thiocyanate.

SD-1

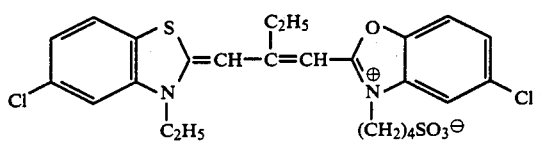

SD-2

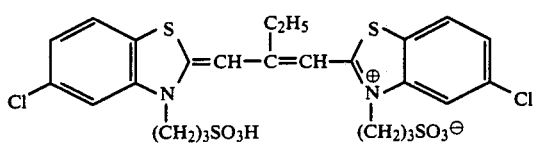

SD-3

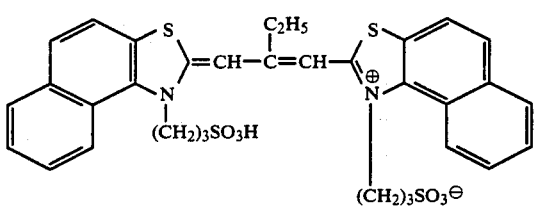

SD-4

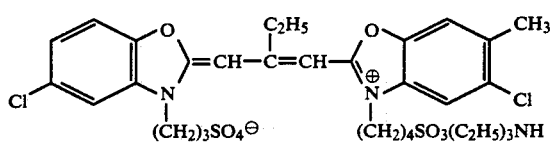

SD-5

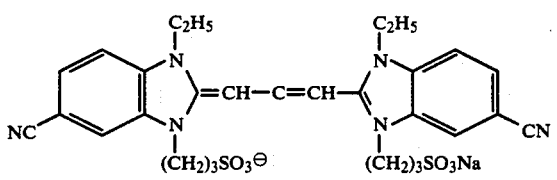

SD-6

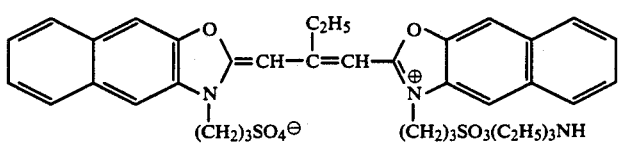

-continued
SD-7
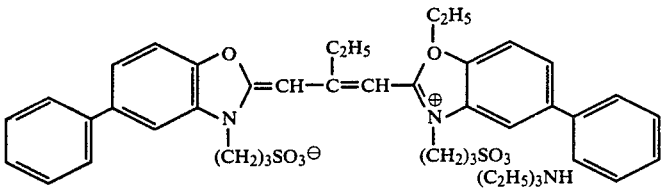
SD-8
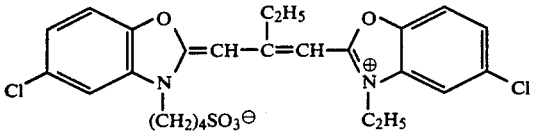
SD-9
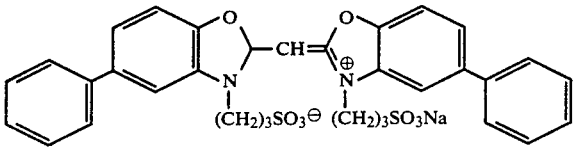
SD-10
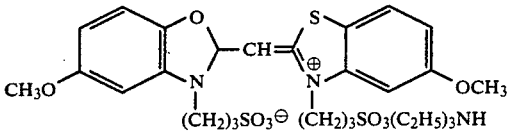
C-1
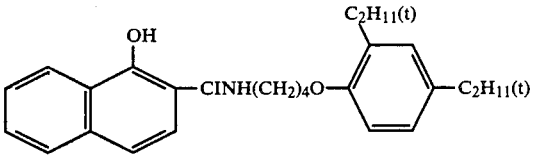
C-2
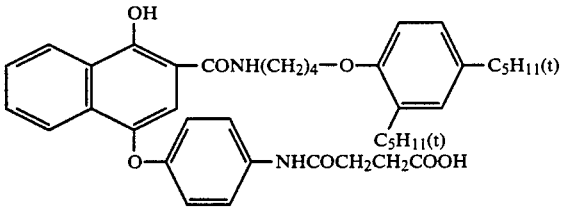
M-1
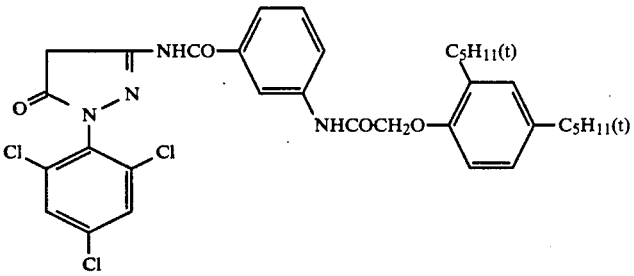
M-2
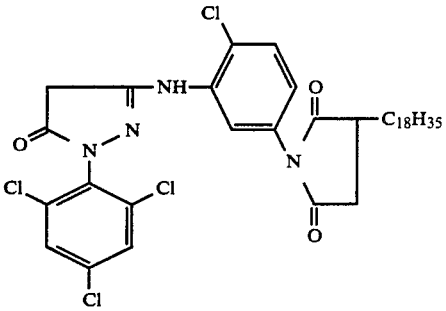

-continued
M-3
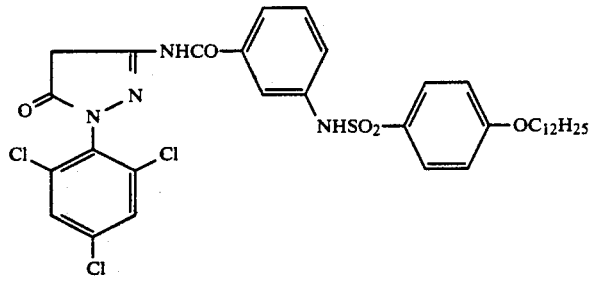
Y-1
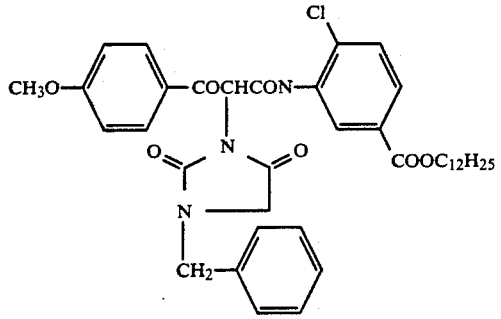
Y-2
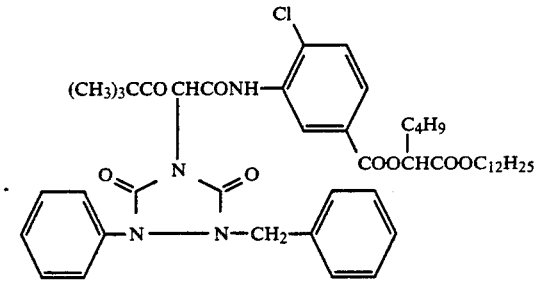
CC-1
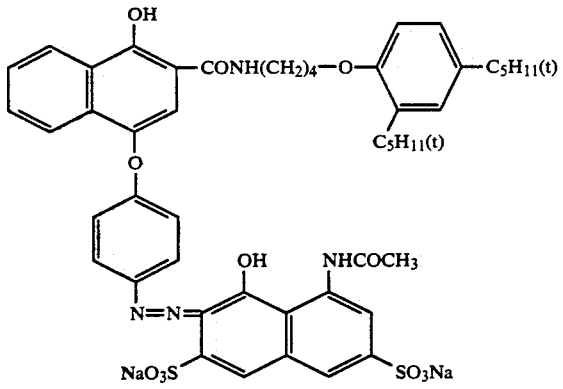
CM-1
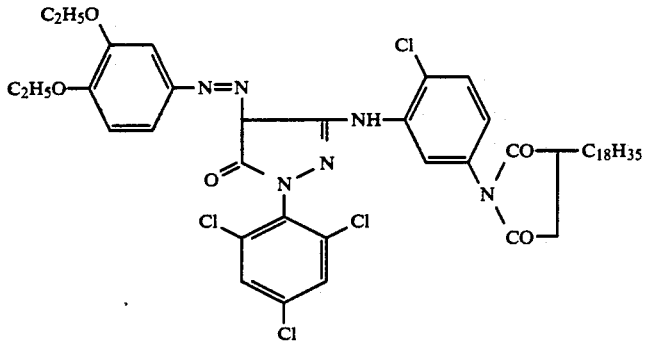

-continued
CM-2
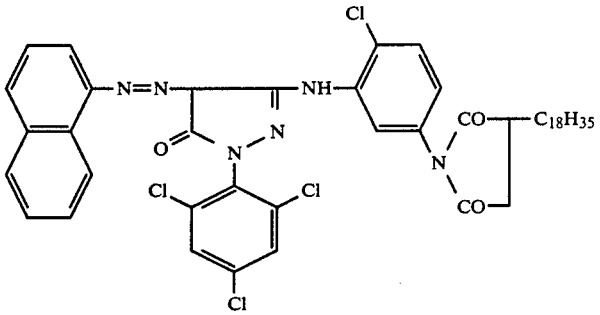
D-1
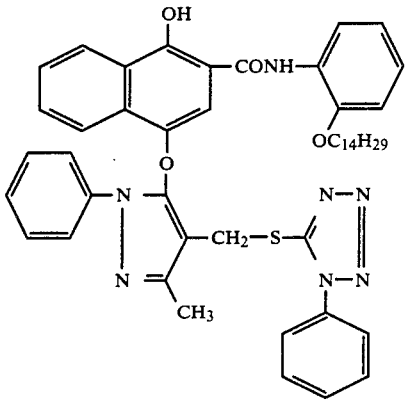
D-2
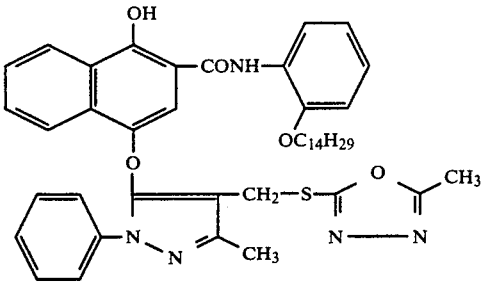
D-3
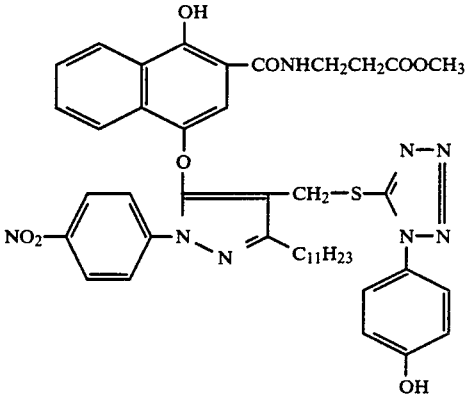

-continued
D-4
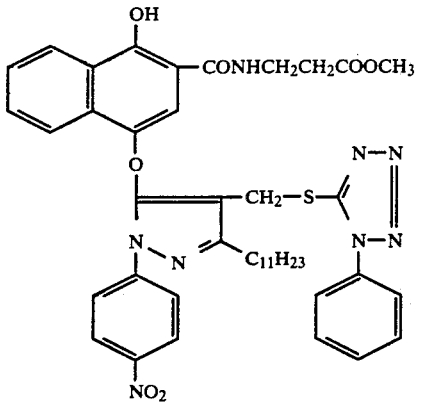
UV-1
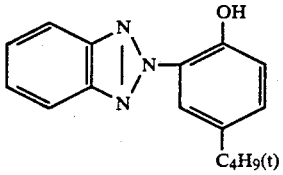
UV-2
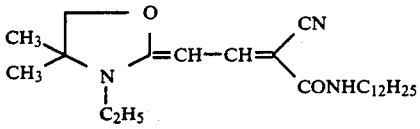
HS-1
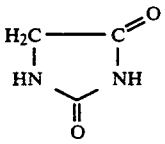
HS-2
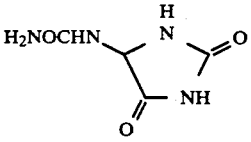
H-1
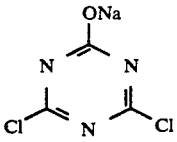
$[(CH_2{=}CHSO_2CH_2)_3CCH_2SO_2(CH_2)_2]_2N(CH_2)_2SO_3K$ H-2
Su-1
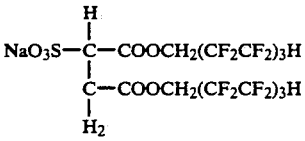
Su-2
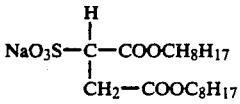
Su-3
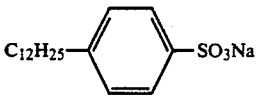

-continued

SC-1

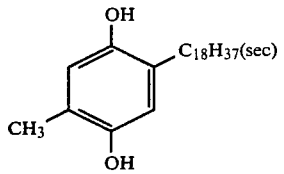

WAX-1

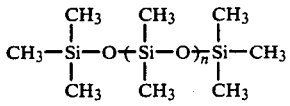

Oil-1

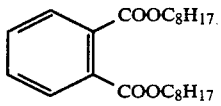

Oil-2

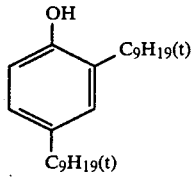

Oil-3

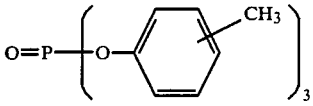

Oil-4

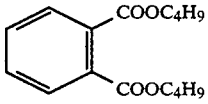

ST-1

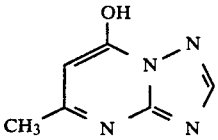

AF-1

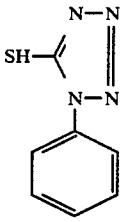

AF-2

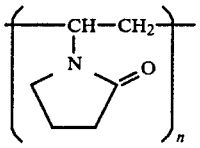

Samples 2 through 9 were prepared in quite the same manner as in Sample 1 except that the emulsions that were used in Sample 1 were replaced by those emulsions as given in Tables 1 and 2. Each of the thus prepared Samples 1 through 9 was conditioned to and hermetically sealed in an atmosphere at a temperature of 23° C. with a relative humidity of 50%, and then allowed to stand at room temperature over a period of 6 months. After that, each sample was exposed through an optical wedge to a white light and then processed in accordance with the following procedure. Subsequently, these aged and processed samples were compared with those same but not aged samples, which were similarly processed without being aged for 6 months, for the evaluation of their preservability.

TABLE 1

| Emulsion | Average grain diameter (μm) | Distribution (%) | Silver iodide content Average | Silver iodide content Peripheral phase | Grain configuration | Grain diameter/ thickness |
|---|---|---|---|---|---|---|
| Em-1 | 0.46 | 14 | 7.0 | 3.0 | Octahedron | 1 |
| Em-2 | 0.30 | 14 | 2.0 | 2.0 | Tetradeca-hedron | 1 |
| Em-3 | 0.81 | 13 | 7.0 | 1.0 | Octahedron | 1 |
| Em-4 | 0.90 | 14 | 8.0 | 0.3 | Octahedron | 1 |
| Em-5 | 0.92 | 19 | 9.0 | 0.5 | Tabular | 8 |
| Em-6 | 0.95 | 12 | 6.0 | 0.0 | Octahedron | 1 |
| Em-7 | 0.85 | 12 | 3.0 | 3.0 | Octahedron | 1 |
| Em-8 | 0.92 | 14 | 4.0 | 4.0 | Cube | 1 |
| Em-9 | 1.2 | 13 | 8.0 | 0.3 | Octahedron | 1 |
| Em-10 | 1.4 | 19 | 9.0 | 0.5 | Tabular | 8 |

TABLE 2

| Sample No. | Layer 4 Em | Layer 4 Additive | | Layer 8 Em | Layer 8 Additive | | Layer 11 Em | Layer 11 Additive | |
|---|---|---|---|---|---|---|---|---|---|
| 1 | 3 | ST | 1.6 | 3 | ST | 1.6 | 4 | ST | 1.3 |
| 2 | 3 | S | 0.2 | 3 | S | 0.2 | 4 | S | 0.15 |
| 3 | 3 | ST | 0.8 | 3 | ST | 0.8 | 4 | ST | 0.6 |
| | | S | 0.1 | | S | 0.1 | | S | 0.08 |
| 4 | 3 | ST | 1.6 | 3 | ST | 1.6 | 4 | ST | 1.6 |
| | | S | 0.2* | | S | 0.2* | | S | 0.2* |
| 5 | 5 | S | 0.17 | 5 | S | 0.17 | 5 | S | 0.17 |
| 6 | 6 | S | 0.16 | 6 | S | 0.16 | 6 | S | 0.16 |
| 7 | 7 | S | 0.2 | 7 | S | 0.2 | 8 | S | 0.2 |
| 8 | 5 | S | 0.17 | 5 | S | 0.17 | 9 | S | 0.15 |
| 9 | 5 | S | 0.17 | 5 | S | 0.17 | 10 | S | 0.13 |

Note:
In Table 2, the asterisked additive of Sample 4 was added at the time of coating liquid preparation, while the other additives were added at the time of chemical ripening. The added amounts are in mg/mol.
ST: Sodium thiosulfate.
S: elementary sulfur At the time of the chemical ripening, besides the above additives, chloroauric acid and ammonium thiocyanate were further added to the emulsions.

Processing Steps (at 38° C.)

| | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions that were used in the above processing steps are as follows:

| | |
|---|---|
| <Color Developer Solution> | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter | |
| <Bleaching Bath> | |
| Ferric-ammonium ethylenediaminetetraacetate | 100.0 g |
| Diammonium ethylenediaminetetraacetate | 10.0 g |
| Ammonium bromide | 150.0 g |
| Glacial acetic acid | 10 ml |
| Water to make 1 liter. Adjust the pH to 6.0 by using aqueous ammonia. | |
| <Fixer Bath> | |
| Ammonium thiosulfate | 175.0 g |
| Anhydrous sodium sulfite | 8.5 g |
| Sodium metabisulfite | 2.3 g |
| Water to make 1 liter. Adjust the pH to 6.0 by using acetic acid. | |
| <Stabilizer Bath> | |
| Formalin (aqueous 37% solution) | 1.5 ml |
| Koniducks (product of Konica Corporation) | 7.5 ml |
| Water to make 1 liter | |

The obtained results are as given in Table 3.

The photographic speed of each sample, expressed as the reciprocal of the exposure necessary to obtain a density comprised of the minimum density +0.1, is indicated in Table 3 as the relative speed to that of Sample 1 regarded as 100.

TABLE 3

| | Sample No. | Not aged Fog B | Not aged Fog G | Not aged Fog R | Not aged Relative speed B | Not aged Relative speed G | Not aged Relative speed R | Aged for 6 months Fog B | Aged for 6 months Fog G | Aged for 6 months Fog R | Aged for 6 months Relative speed B | Aged for 6 months Relative speed G | Aged for 6 months Relative speed R |
|---|---|---|---|---|---|---|---|---|---|---|---|---|---|
| Com. | 1 | 0.12 | 0.10 | 0.10 | 100 | 100 | 100 | 0.20 | 0.18 | 0.20 | 85 | 90 | 90 |
| Inv. | 2 | 0.06 | 0.04 | 0.05 | 125 | 115 | 115 | 0.07 | 0.05 | 0.06 | 120 | 115 | 115 |
| | 3 | 0.07 | 0.06 | 0.07 | 115 | 110 | 110 | 0.09 | 0.08 | 0.09 | 110 | 105 | 105 |
| | 4 | 0.08 | 0.07 | 0.08 | 110 | 105 | 105 | 0.10 | 0.10 | 0.10 | 105 | 100 | 100 |
| | 5 | 0.07 | 0.05 | 0.06 | 120 | 120 | 115 | 0.08 | 0.07 | 0.08 | 115 | 115 | 110 |
| | 6 | 0.06 | 0.04 | 0.05 | 125 | 115 | 120 | 0.07 | 0.06 | 0.08 | 120 | 110 | 115 |
| Com. | 7 | 0.07 | 0.06 | 0.07 | 105 | 95 | 90 | 0.15 | 0.11 | 0.13 | 80 | 75 | 70 |
| Inv. | 8 | 0.07 | 0.05 | 0.06 | 130 | 120 | 115 | 0.07 | 0.07 | 0.08 | 130 | 115 | 110 |
| | 9 | 0.06 | 0.05 | 0.06 | 135 | 115 | 120 | 0.06 | 0.07 | 0.08 | 135 | 115 | 110 |

Note:
Com. - Comparative
Inv. - Invention

As is apparent from the results shown in Table 3, the samples of this invention show high sensitivities and low fogs as compared to the comparative samples, thus showing that the invention is significantly effective in improving the stability with time of the characteristics.

What is claimed is:

1. A silver halide photographic light-sensitive material comprising a support having thereon a photographic component layer including at least one silver halide emulsion layer, in which said silver halide emulsion layer comprises silver halide grains, each of which is comprised of two or more phases different in the silver iodide content, wherein the average silver iodide content of said grain is higher than the silver iodide content of the external phase of said grain, and to at least one layer included said photographic component layer is added elementary sulfur in a step of the manufacturing process of said silver halide photographic light-sensitive material.

2. The material of claim 1, wherein said average silver iodide content of said silver halide grain is with in the range of from 2 to 20 mol %.

3. The material of claim 2, wherein said average silver iodide content of said silver halide grain is within the range of from 5 to 15 mol %.

4. The material of claim 3, wherein said average silver iodide content of said silver halide grain is within the range of from 6 to 12 mol %.

5. The material of claim 1, wherein said silver halide grains have a ratio of grain diameter to grain thickness of less than 5 in average.

6. The material of claim 5, wherein silver the iodide content on the surface of said silver halide grains is within the range of from 0 to 6 mol %.

7. The material of claim 6, wherein the silver iodide content on the surface of said silver halide grains is within the range of from 0 to 5 mol %.

8. The material of claim 7, wherein the silver iodide content on the surface of said silver halide grains is within the range of from 0.01 mol % to 4 mol %.

9. The material of claim 1, wherein said silver halide grains are tabular grains having, a ratio of grain diameter to grain thickness of not less than 5 in average.

10. The material of claim 9, wherein said ratio of grain diameter to grain thickness is within the range of from 6 to 100.

11. The material of claim 10, wherein said ratio of grain diameter to grain thickness is within the range of from 7 to 50.

12. The material of claim 9, wherein the silver iodide content of said tabular silver halide grains at a point more than 80% away in the diameter direction from their center is within the range of from 0 to 6 mol %.

13. The material of claim 12, wherein the silver iodide content of said tabular silver halide grains at a point more than 80% away in the diameter direction from their center is within the range of from 0 to 5 mol %.

14. The material of claim 13, wherein the silver iodide content of said tabular silver halide grains at a point more than 80% away in the diameter direction from their center is within the range of from 0.01 mol % to 4 mol %.

15. The material of claim 1, wherein said elementary sulfur is added to said silver halide emulsion layer.

16. The material of claim 1, wherein said elementary sulfue is added to a non-light-sensitive hydrophilic colloid layer included in said photographic component layer.

17. The material of claim 1, wherein said elementary sulfur is added in an amount of from $10^{-5}$ mg to 10 mg per mol of silver halide.

* * * * *

UNITED STATES PATENT AND TRADEMARK OFFICE

CERTIFICATE OF CORRECTION

PATENT NO. : 5,004,680

DATED : April 02, 1991

INVENTOR(S) : Toshihiko Yagi et al.

It is certified that error appears in the above-identified patent and that said Letters Patent is hereby corrected as shown below:

In the Abstract, Line 12, after "included" insert --in--;

In the Abstract, Line 13, after "of" insert --the--;

Claim 1, Column 23, Line 13, after "included" insert --in--;

Claim 2, Column 23, Line 18, change "with in" to --within--;

Claim 6, Column 23, Line 30, change "silver the" to --the silver--;

Claim 9, Column 24, Line 5, after "having" delete " , ";

UNITED STATES PATENT AND TRADEMARK OFFICE

CERTIFICATE OF CORRECTION

PATENT NO. : 5,004,680

DATED : April 02, 1991

INVENTOR(S) : Toshihiko Yagi, et al

It is certified that error appears in the above-identified patent and that said Letters Patent is hereby corrected as shown below:

Claim 16, Column 24, line 29, change "sulfue" to --sulfur--.

Signed and Sealed this

Fifth Day of January, 1993

*Attest:*

DOUGLAS B. COMER

*Attesting Officer*

*Acting Commissioner of Patents and Trademarks*